US010292498B2

(12) United States Patent
DeJule et al.

(10) Patent No.: US 10,292,498 B2
(45) Date of Patent: May 21, 2019

(54) APPARATUS WITH WEIGHT RESPONSIVE CHANGEABLE ADJUSTING CHARACTERISTICS

(71) Applicants: Aaron DeJule, River Forest, IL (US); Scott Padiak, Glance, IL (US); Paul C. Evans, Bellaire, MI (US)

(72) Inventors: Aaron DeJule, River Forest, IL (US); Scott Padiak, Glance, IL (US); Paul C. Evans, Bellaire, MI (US)

( * ) Notice: Subject to any disclaimer, the term of this patent is extended or adjusted under 35 U.S.C. 154(b) by 272 days.

(21) Appl. No.: 15/040,735

(22) Filed: Feb. 10, 2016

(65) Prior Publication Data

US 2016/0227935 A1 Aug. 11, 2016

Related U.S. Application Data

(60) Provisional application No. 62/114,706, filed on Feb. 11, 2015.

(51) Int. Cl.

| | |
|---|---|
| ***A47C 7/44*** | (2006.01) |
| ***A47C 1/032*** | (2006.01) |
| ***A47C 31/12*** | (2006.01) |

(52) U.S. Cl.

CPC ..... *A47C 7/445* (2013.01); *A47C 1/03266* (2013.01); *A47C 1/03277* (2013.01); *A47C 7/441* (2013.01); *A47C 7/443* (2013.01); *A47C 31/126* (2013.01)

(58) Field of Classification Search

CPC ..... A47C 7/445; A47C 7/441; A47C 1/03277; A47C 1/03266

See application file for complete search history.

(56) References Cited

U.S. PATENT DOCUMENTS

| | | | | |
|---|---|---|---|---|
| 4,911,501 | A * | 3/1990 | Decker | A47C 1/03255 297/285 |
| 4,962,962 | A | 10/1990 | Machate et al. | |
| 6,250,715 | B1 * | 6/2001 | Caruso | A47C 1/03 297/300.2 |
| 8,025,334 | B2 | 9/2011 | Schmitz et al. | |
| 2006/0202530 | A1 * | 9/2006 | Lin | A47C 1/03238 297/300.1 |
| 2008/0088163 | A1 * | 4/2008 | Sander | A47C 1/03255 297/300.4 |

(Continued)

FOREIGN PATENT DOCUMENTS

DE 37 00447 A1 1/1987

*Primary Examiner* — Timothy J Brindley

(74) *Attorney, Agent, or Firm* — Wood, Phillips, Katz, Clark & Mortimer

(57) ABSTRACT

A reconfigurable apparatus having: a frame; at least a first component on the frame upon which a force is applied in a first manner in using the apparatus for its intended purpose; and at least a second component on the frame that is movable relative to the at least first component and/or the frame and upon which a force can be applied in a second manner to reconfigure the apparatus by moving the at least second component relative to the at least first component and/or the frame. An adjusting assembly cooperates between the at least first component and the at least second component and is configured so that as an incident of the force being applied in the first manner changing, the force being applied in the second manner required to reconfigure the apparatus changes.

22 Claims, 6 Drawing Sheets

(56) References Cited

U.S. PATENT DOCUMENTS

| | | | | |
|---|---|---|---|---|
| 2009/0261637 | A1* | 10/2009 | Schmitz | A47C 1/03255<br>297/217.2 |
| 2009/0267394 | A1* | 10/2009 | Bock | A47C 1/03255<br>297/300.2 |
| 2012/0025574 | A1* | 2/2012 | Wilkinson | A47C 1/03<br>297/300.1 |
| 2013/0169017 | A1* | 7/2013 | Masunaga | A47C 1/03255<br>297/320 |
| 2015/0123441 | A1* | 5/2015 | Duke | A47C 1/03255<br>297/300.4 |
| 2016/0100691 | A1* | 4/2016 | Masunaga | A47C 7/462<br>297/285 |

* cited by examiner

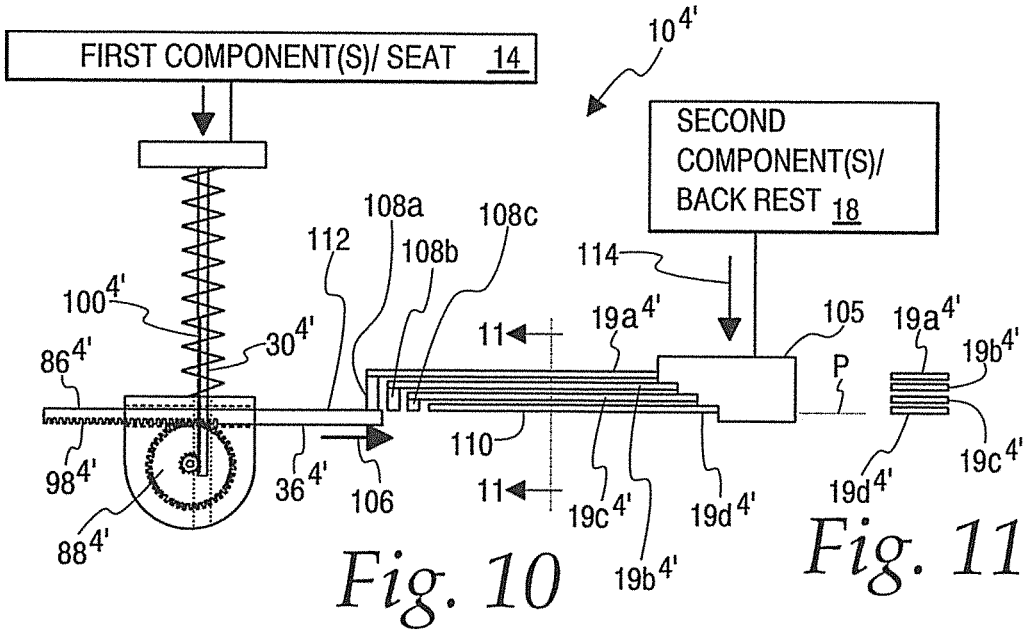
Fig. 10
Fig. 11
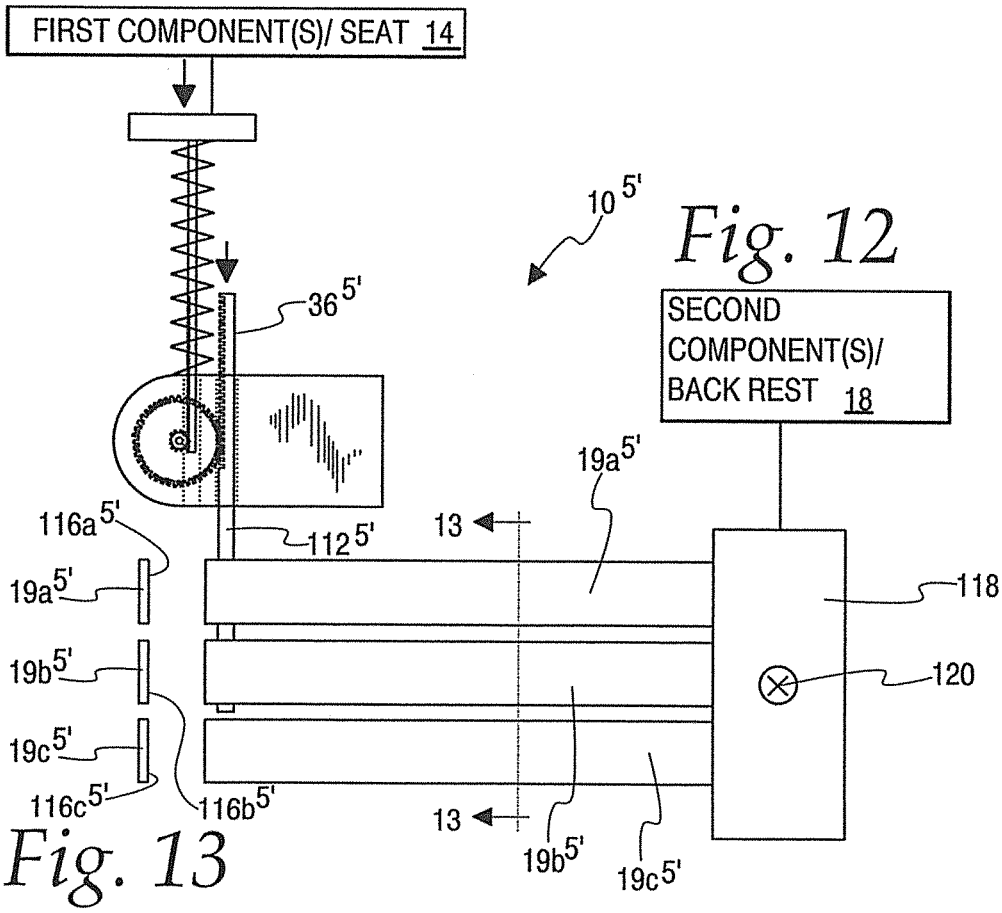
Fig. 12
Fig. 13

APPARATUS WITH WEIGHT RESPONSIVE CHANGEABLE ADJUSTING CHARACTERISTICS

BACKGROUND OF THE INVENTION

Field of the Invention

This invention relates to apparatus upon which variable weight is applied during normal use and, more particularly, to an apparatus having at least one part with different adjusting characteristics during normal use depending upon the particular applied weight.

Background Art

A very significant percentage of furniture sold commercially has an ability to be adjusted/reconfigured to accommodate users with different body types and demands. As one example, task chairs are routinely engineered so that a single design can be offered with a substantial amount of versatility in terms of how it can be adapted to size and weight of different individuals so as to optimize function and comfort level.

In a typical task chair construction, a wheeled frame supports a vertically adjustable seat. A back rest is integrated into the frame and/or seat so that it can be tilted or reclined to accommodate a user's normal movements and/or to allow inclined back positions to be comfortably maintained by the user's upper torso weight as he/she is sitting. The task chairs may be made with or without armrests. When utilized, armrests are commonly made to be at least vertically adjustable to allow comfortable support for a user that may be different depending upon the particular user's build and/or the task(s) to be performed using the chair.

Reconfigurable designs are also commonly incorporated into seating used for leisure activities. Reading chairs and sectional pieces on modular furniture commonly have such an adjusting capability.

With a single design, performance of a particular seating apparatus will be different depending upon the weight of a user. For example, a heavier individual may be able to comfortably urge a back rest towards an inclined position and comfortably maintain potentially a number of different, desired, inclined positions within a range. On the other hand, a lighter individual with the same design may have to engage in a more unnatural movement and constantly exert a pressure on the seat back to prevent it from returning to its normal upright position, generally maintained through some sort of biasing mechanism.

Similar tilt features may be integrated into the seat itself with a user's weight affecting how the mechanisms will operate.

One industry solution to the above problem is to provide manual adjusting capabilities whereby biasing forces on movable components can be changed. For example, a mechanism has been incorporated that allows a user to change a spring force on a back rest to be more compatible with that user's weight.

Tilt and tension adjustment is typically achieved by rotating a knob or pulling a lever, which loads a spring. Once the chair is optimally adjusted, the user can recline to a comfortable backward distance. However, to optimize balance, the user must iteratively lean back and adjust. This process of adjusting tension and tilt by pulling a lever or turning a knob may require many rotations or pulls depending on the weight of the previous user, resulting in potentially wasted time and imperfect adjustments.

With the multitude of different manual adjusting capabilities currently in existing furniture designs, user operation is becoming more complicated. Even a basic task chair often has multiple actuators which a user is required to manually operate to customize a chair for his/her purposes. Oftentimes, such mechanisms are confusing to users who may default to simply using a chair in its current configuration, even if not optimally configured. This problem is aggravated when persons routinely move from chair to chair during a typical work day in certain office environments in which there are group meetings, training, collaboration at different locations, sharing of resources such as at computer stations, etc. This same sharing of chairs occurs in classrooms, libraries, open plan offices, etc.

The current demand for versatility may demand integration of adjusting mechanisms on even base line furniture. To control manufacturing costs, the quality of many of these mechanisms, and potentially the overall chair, may be compromised.

The challenges of providing customizable adjusting systems, while demonstrated in the chair environment above, is not so limited. Many different apparatus use adjusting components that rely on a certain balance that may be affected by a variable weight application encountered in normal use. As but one example, desktop mechanisms are now evolving which allow a user to elevate a work surface so that he/she has the option of either sitting or standing while working on a computer or performing other routine work day tasks. Ideally, a user has the ability to raise and lower the work surface in a range, and to maintain a desired position, without having to operate any locking or adjusting mechanisms. Given that different jobs require placement of different items on the work surface, the applied weight on the work surface may vary considerably, which makes a generic design difficult to practically construct.

These problems are contended with also in different environments and with different types of equipment outside of the furniture arena. In any environment wherein components are adjustable, designers strive to design systems so that they are affordable, reliable, and user friendly. Balancing these often competing objectives remains an ongoing challenge.

SUMMARY OF THE INVENTION

In one form, the invention is directed to a reconfigurable apparatus having: a frame; at least a first component on the frame upon which a force is applied in a first manner in using the apparatus for its intended purpose; at least a second component on the frame that is movable relative to the at least first component and/or the frame and upon which a force can be applied in a second manner to reconfigure the apparatus by moving the at least second component relative to the at least first component and/or the frame; and an adjusting assembly cooperating between the at least first component and the at least second component. The adjusting assembly is configured so that as an incident of the force being applied in the first manner changing, the force being applied in the second manner required to reconfigure the apparatus changes.

In one form, the second component is guided in pivoting movement relative to the at least first component and/or the frame around an axis.

In one form, the reconfigurable apparatus is a piece of furniture.

In one form, the reconfigurable apparatus is a chair. The at least first component is in the form of a seat upon which a user applies the force in the first manner by sitting in the chair.

In one form, the at least second component is in the form of a back rest against which a user seated in the chair leans to exert the force in the second manner to reconfigure the chair.

In one form, the adjusting assembly includes a spring assembly that is configured to exert a force that resists movement of the at least second component and that varies as a magnitude of the force applied in the first manner varies.

In one form, the spring assembly has a leaf spring with a length that is bendable about a fulcrum location. The adjusting assembly and at least second component are configured so that as the force applied in the first manner changes in magnitude, an effective length of the leaf spring changes.

In one form, the adjusting assembly is configured so that an increase in magnitude of the force applied in the first manner causes an increase in magnitude of the force applied in the second manner required to reconfigure the apparatus.

In one form, the leaf spring has a cross-sectional shape, as viewed orthogonally to its length, that is non-uniform over at least a portion of the length of the leaf spring.

In one form, the spring assembly has a plurality of leaf springs each with a length that bends around a fulcrum location.

In one form, the adjusting assembly and at least second component are configured so that a different number of said plurality of leaf springs exerts a force that resists movement of the at least second component based upon a magnitude of the force applied in the first manner.

In one form, the spring assembly has an elongate spring component with a length that exerts the force that resists movement of the at least second component in line with the length of the spring.

In one form, the second component is guided in pivoting movement relative to the at least first component and/or the frame around an axis. The second component and adjusting assembly are configured so that the elongate spring component exerts the force that resists movement of the at least second component at a distance from the axis that changes as a magnitude of the force applied in the first manner changes.

In one form, the spring assembly has at least one leaf spring.

In one form, the at least one leaf spring has a length and spaced supported ends. The apparatus further includes an actuating component that is configured to bear against the one leaf spring between the spaced supported ends to resist movement of the at least second component as the force is applied in the second manner with a magnitude that reconfigures the apparatus.

In one form, the spring assembly has a torsion component with an axis. The apparatus further includes an actuating component that is configured to turn the torsion component around the axis to generate the force that resists movement of the at least second component as the force is applied in the first manner with a magnitude that reconfigures the apparatus.

In one form, the actuating component and torsion component are configured so that the actuating component engages the torsion component at different locations along the axis of the torsion component as a magnitude of the force applied in the first manner changes.

In one form, the adjusting assembly has cooperating toothed elements that move relative to each other as a magnitude of the force applied in the first manner reaches a predetermined level.

In one form, the seat is configured to move vertically relative to the frame with the first force applied in the first manner with a magnitude that reaches a predetermined level.

In one form, the apparatus further includes a supporting biasing assembly that normally biasably urges the seat upwardly relative to the frame.

BRIEF DESCRIPTION OF THE DRAWINGS

FIGS. 7-16 are partially schematic representations of apparatus incorporating different forms of adjusting assemblies, according to the invention;

DETAILED DESCRIPTION OF THE PREFERRED EMBODIMENT

Figure 1:
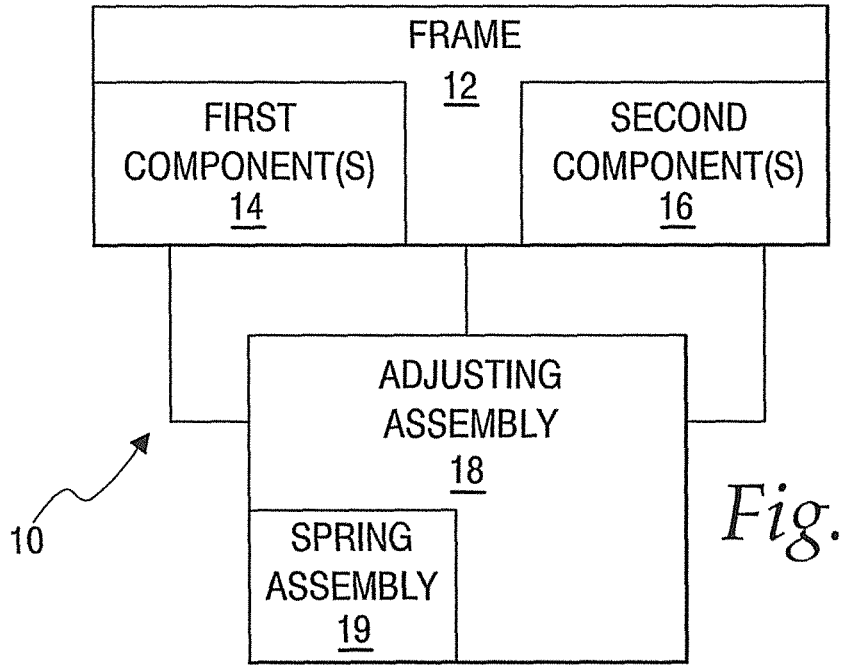
FIG. 1 is a schematic representation of a reconfigurable apparatus, according to the present invention.

In FIG. 1, a reconfigurable apparatus, according to the present invention, is shown in schematic form at 10. The apparatus 10 consists of a frame 12 and at least a first component 14 on the frame 12 upon which a force is applied in a first manner in using the apparatus 10 for its intended purpose.

At least a second component 16 is provided on the frame 12 and is movable relative to the at least first component and/or the frame 12. A force can be applied in a second manner upon the at least second component to reconfigure the apparatus 10 by moving the at least second component 16 relative to the at least first component and/or the frame 12.

An adjusting assembly 18 cooperates between the at least first component 14 and the at least second component 16 and is configured so that, as an incident of the force being applied in the first manner changing, the force applied in the second manner required to reconfigure the apparatus 10 changes.

The adjusting assembly 18 includes a spring assembly 19. The spring assembly 19 is configured to exert a force that resists movement of the at least second component 16 that varies as a magnitude of the force applied in the first manner varies.

The generic showing of the apparatus 10 is intended to encompass a wide range of different products and different applications. The inventive concepts can be used in virtually any system or apparatus wherein its normal intended use requires the application of a force on a first component and wherein that force on the first component impacts a force required to be applied to a second component to reconfigure the apparatus as contemplated during use.

While not intended to be limiting, the detailed description herein will be focused upon furniture and, more particularly, a chair construction. This application of the inventive concepts is intended to be exemplary in nature only and should not be viewed as limiting the inventive concepts to the specific type of apparatus described in detail herein. Further, the schematic showing in FIG. 1 is intended to encompass not only a wide range of different systems/apparatus, but different forms of components and their interaction for each such system/apparatus.

For example, interlocking toothed components are described, in exemplary forms below. The invention contemplates not only different types of toothed components, such as gears, differential gears, epicyclic gears, rack and pinion arrangements, etc., but also virtually an unlimited number of different interengaging components, such as sprockets and chains, pulleys and cables, mechanisms using levers, pistons, different types of linkages, etc.

Figure 2:
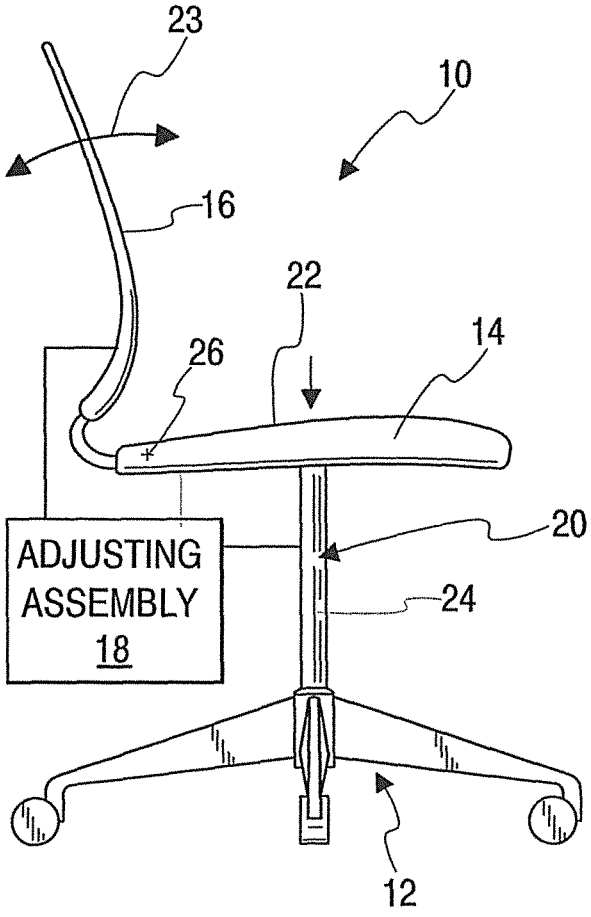
FIG. 2 is a side elevation view of a task chair, that is one representative form of apparatus as shown in FIG. 1, and incorporating an adjusting assembly according to the present invention.

In FIG. 2, one exemplary apparatus 10 is shown in the form of a task chair, in this case without armrests. Of course, armrests might be incorporated and might also have parts thereof movable in different manners depending upon the weight of the user, as hereinafter explained.

The chair 10 has a wheeled frame 12 with a vertically extending pedestal assembly 20. The first component 14 is in the form of a conventional-type seat with an upwardly facing user support surface 22. In this case, the aforementioned force applied in the first manner is the weight of the user exerted downwardly on the support surface 22 as he/she sits on the chair 10.

A corresponding second component 16 is in the form of a back rest against which a seated user leans to exert the aforementioned force in the second manner to reconfigure the chair 10. That is, the back rest moves relative to the frame 12 and first component 14, as the user leans back and forth while seated, generally in a manner as indicated by the double-headed arrow 23.

The adjusting assembly 18, as shown schematically in FIG. 2, acts between the first component/seat 14 and second component/back rest 16 directly and/or through the frame 12. The adjusting assembly 18 may be added to the frame 12 by attachment thereto, virtually anywhere thereon, or integrated thereinto, as by being constructed within a hollow 24 on the pedestal assembly 20.

The chair 10 may incorporate one or more adjusting features other than one that permits reconfiguration by changing the angle of the second component/back rest 16. The adjusting assembly 18 may be integrated into the mechanisms associated with these other features. Alternatively, the other features may operate without effect by the adjusting assembly 18.

For purposes of simplicity, the second component/back rest 16 will be shown as repositionable relative to the first component/seat 14 to reconfigure the chair 10 by movement of the second component/back rest 16 relative to the first component/seat 14 and frame 12 around a pivot axis 26. This particular connection should not be viewed as limiting.

Exemplary specific forms of the adjusting assembly 18 will now be described. As noted above, virtually an unlimited number of different variations of adjusting assembly are contemplated within the generic showing of FIGS. 1 and 2. These specific forms are exemplary in nature only. These particular mechanisms will also be described with respect to the apparatus in the form of a chair as shown in FIG. 2. Again, the particular nature of the apparatus is not limited to a chair or furniture, although it has particular applicability in this category of product.

Figure 4:
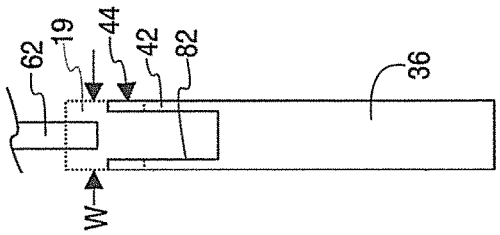
FIG. 4 is a fragmentary view of a part of the adjusting assembly in FIG. 3, which utilizes a leaf spring, and from a different perspective.
Figure 3:
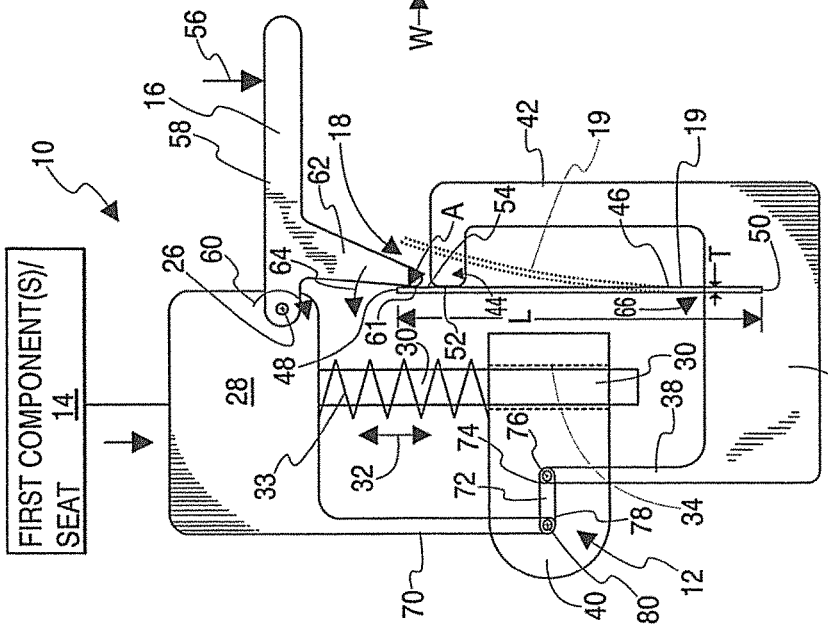
FIG. 3 is a partially schematic representation of one specific form of adjusting assembly, integrated into the apparatus in FIGS. 1 and 2.

In FIGS. 3 and 4, the first component/seat 14 (hereinafter referred to only as the representative chair "seat 14") is integrated into a support 28 that has a depending post 30 that is slidable guidingly vertically, as indicated by the double-headed arrow 32, in a guide channel 34 on the frame 12. A biasing assembly, shown in one exemplary form as a coil spring 33, normally biasably urges the seat 14 upwardly relative to the frame 12.

A generally U-shaped member 36 has one leg 38 of the "U" mounted on a frame part 40. The other leg 42 of the "U" has an offset bracing end 44.

For purposes of simplicity, the support 28 and member 36 can be considered to be part of the frame 12 and/or the adjusting assembly 18. Similarly, the component 58 can be considered to be part of the back rest 16 and/or the adjusting assembly 18.

The spring assembly 19 in this embodiment is in the form of a leaf spring. The leaf spring 19 has an elongate body 46 with a length L between spaced ends 48, 50, a width W, and a thickness T.

The leaf spring end 19 is anchored in the member 36 to project in cantilever fashion vertically upwardly therefrom. In this embodiment, the body 46 of the leaf spring 19 is preloaded so that it naturally assumes the dotted line shape and position.

The bracing end 44 of the member 36 is bifurcated, as seen in FIG. 4, with spaced edges 52 (one shown) at the extremity of the bracing end 44 engageable with one surface 54 of the leaf spring body 46 to maintain the body 46 in the straight vertical orientation, as shown in FIG. 3.

A part of the second component/back rest 16 (hereafter referred to only as the representative chair "back rest 16") is connected to the support 28 for movement relative thereto around the axis 26 as seen in FIG. 2. As a user situated on the seat 14 leans against the back rest 16, a force is generated as shown by the arrow 56 on the back rest component 58 that tends to pivot the component 58 in the direction of the arrow 60 around the axis 26.

The component 58 is configured so that an edge 61 on a cantilevered part 62 thereof bears against the leaf spring surface 54. In the depicted state, this produces a force upon the leaf spring body 46, at a location A along the length of the body 46, that tends to bend the body 46 in the direction of the arrow 64 around a fulcrum location at 66 where the body 46 projects away from the part of the member 36 in which it is anchored. The leaf spring 19 thus biasably resists movement of the component 58, and the back rest 16 of which the component 58 is a part, with a first force.

The configuration in FIG. 3, while it could show a starting state without any force application on the seat 14, is also representative of the overall state of the apparatus 10 with an individual of a first weight seated thereon. This is an equilibrium position for the chair 10 resulting from the balancing of the user's weight and the upward biasing force generated by the spring 33 acting between the frame 12 and the seat 14 through the support 28.

In the event that an individual of greater weight assumes a sitting position on the seat 14, the support 28 and component 58 will translate further downwardly against the force of the spring 33, which causes the edge 61 on the back rest component 58 to bear upon the leaf spring 19 at a location below the location A. As a result, a shorter moment arm is established between the location where the edge 61 on the part 62 contacts the surface 54 and the fulcrum location at 66. Thus, the leaf spring 19 has an effectively shorter length, whereby a greater force is required to be applied to the leaf spring 19 to effect bending thereof as would in turn allow movement of the back rest 16 to reconfigure the chair 10.

To stabilize the support 28, a depending arm 70 thereon connects to the frame part 40 through a link 72. One link end 74 moves about an axis 76 that is fixed relative to the frame part 40. The other link end 78 pivotally connects to the arm 70 for movement about an axis 80.

The bifurcated configuration of the leg 42 allows the part 62 on the component 58 to move in an opening 82 through the region at the offset bracing end 44 so that the member 36 does not interfere with the back rest component 58 as the back rest component 58 lowers under increasing user weight.

Accordingly, an increase in the weight of a user causes the leaf spring 19 to produce a greater resistance to movement of the back rest 16 relative to the frame 12. As a result, the chair is self-adjusting. The parts thereof can be engineered so that a desired relationship between the user's weight and the force required to move the back rest 16 are appropriately established.

Figure 5:
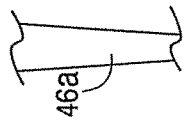
FIG. 5 is an enlarged, fragmentary view of a modified form of a leaf spring utilized on the apparatus in FIGS. 3 and 4.

In designing the chair 10 using a leaf spring component, the leaf spring body 46 may have a uniform cross-sectional shape as viewed orthogonally to its length. Alternatively, this shape may be non-uniform over at least a portion of its length. For example, as shown for a portion of the length of a modified form of body 46*a*, as shown in FIG. 5, the cross-sectional area varies progressively.

Tapering the cross-sectional area of the leaf spring over its length may allow further tuning of performance. Thickened regions may be provided to produce larger resistance forces for users at the higher weight end of the functional range.

The leaf spring material may be metal, plastic, a composite, etc. The leaf spring may be straight, curved, with changing cross-sectional shapes, etc. Changing shapes, preloading, changing dimensions, etc., are just examples of options that might be practiced to design and tune the adjusting assemblies so that they adapt more appropriately to users throughout a workable user weight range.

Figure 6:
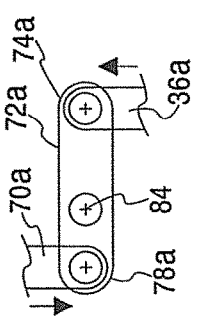
FIG. 6 is an enlarged, fragmentary, elevation view of a linkage, modified from a corresponding linkage as used on the apparatus in FIGS. 3 and 4.

In a still further modified form of the structure in FIG. 3, as shown in FIG. 6, the link 72*a*, corresponding to the link 72, can be connected to the frame 12 for pivoting movement about an axis 84 between its ends 74*a*, 78*a*. Accordingly, as the arm 70*a* moves downwardly under increasing user weight, link 72*a* pivots around the axis 84 so that the member 36*a* simultaneously moves upwardly. Thus, for each incremental movement of the seat 14 downwardly, there is a greater movement of the edge 61 on the part 62 toward the fulcrum location 66 for the leaf spring 19 than occurs with the design in FIGS. 3 and 4.

Figure 7:
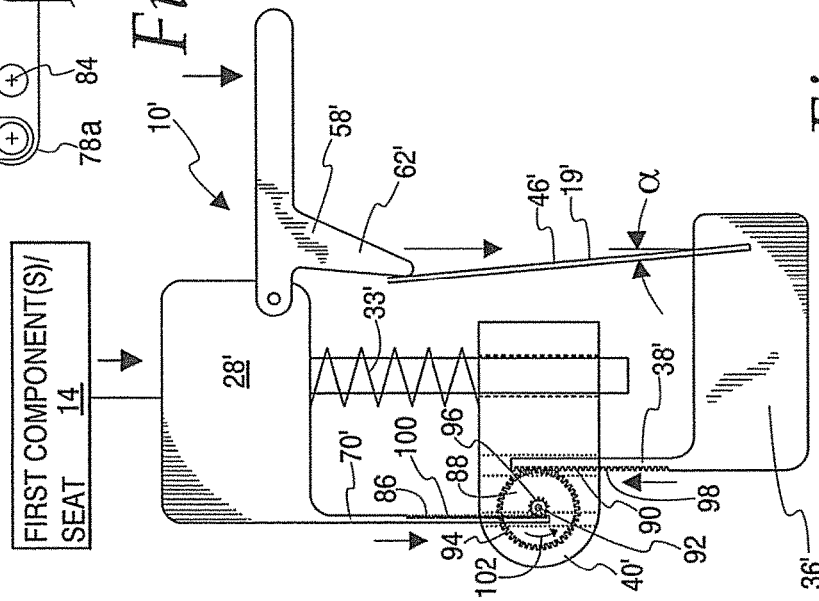

In FIG. 7, a modified form of chair is shown at 10', with elements corresponding to those in FIGS. 3 and 4 identified with like reference numerals and a "'" designation.

The chair 10' has a back rest component 58' that acts against a leaf spring 19' that is anchored in a component 36'.

In this embodiment, the leaf spring body 46' is mounted at a slight angle α to vertical. Accordingly, the part 62' of the component 58' tends to bind more with the leaf spring 19' as it slides downwardly thereagainst under increasing user weight. This binding creates frictional forces that augment the upward balancing force produced by the spring 33'.

Additionally, the chair 10' utilizes cooperating toothed elements 86, 88, 90 that interact to cause movement of the frame part 40', arm 70' and leg 38' relative to each other and the frame part 40' that replicates the relative movement that occurs with corresponding elements in the embodiment shown in FIGS. 3 and 4. The toothed element 88 is in the form of a differential pinion that turns around an axis 92. Larger and smaller diameter toothed portions 94, 96, respectively, engage toothed racks 98, 100, respectively on the leg 38' and arm 70'. Turning of the toothed element 88 in the direction of the arrow 102 under increasing user weight causes simultaneous upward movement of the member 36' and downward movement of the support 28'.

Figure 8:
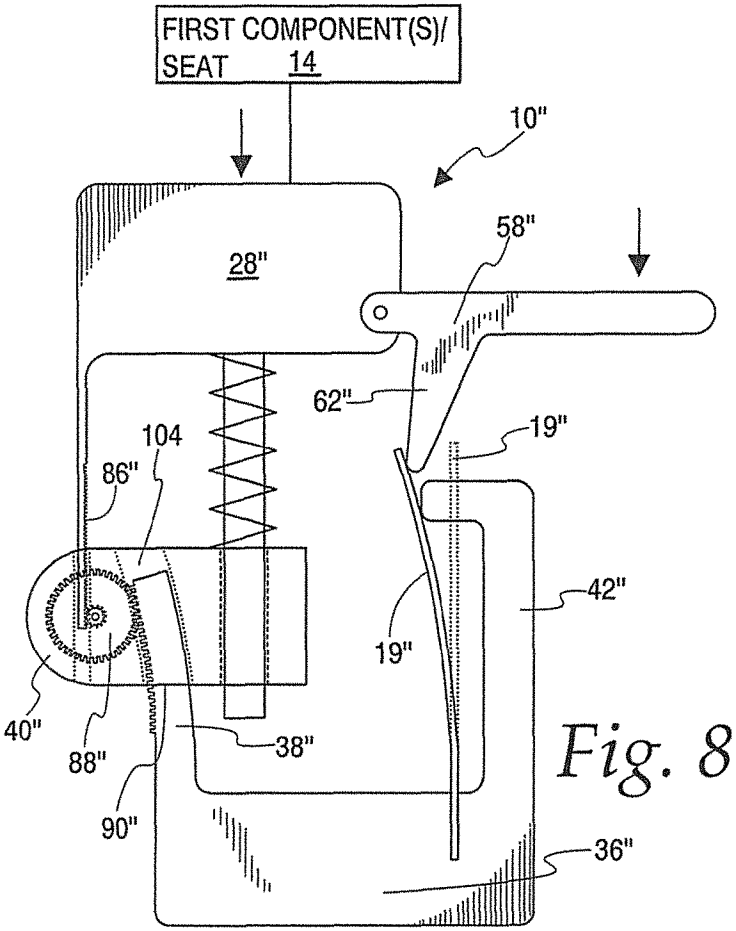

In FIG. 8, a further modified form of chair, according to the present invention, is shown at 10". The chair 10" incorporates a back rest component 58" that interacts with a leaf spring 19" and leg 42" in the same way that the corresponding components interact on the chair 10 in FIGS. 3 and 4.

Further, the chair 10" incorporates toothed elements 86", 88", 90" which function essentially in the same manner as the corresponding components on the chair 10' in FIG. 7. The primary difference between these embodiments is that the leg 38" has a curved shape that moves in a complementarily-curved channel 104 on the frame part 40". Whereas the support 28' associated with the seat 14 and member 36' move relative to each other in parallel, straight paths, the member 36" moves in a curved path, as dictated by the curvature of the leg 38" and cooperating channel 104. This curvature nominally matches the curved shape of the leaf spring 19" which is pre-loaded from the dotted line position to the operative, solid line position in FIG. 8. Accordingly, the relative movement of the member 36" and support 28" causes the part 62" that engages the leaf spring 19" to generally follow the pre-loaded curvature of the leaf spring 19".

Figure 9:
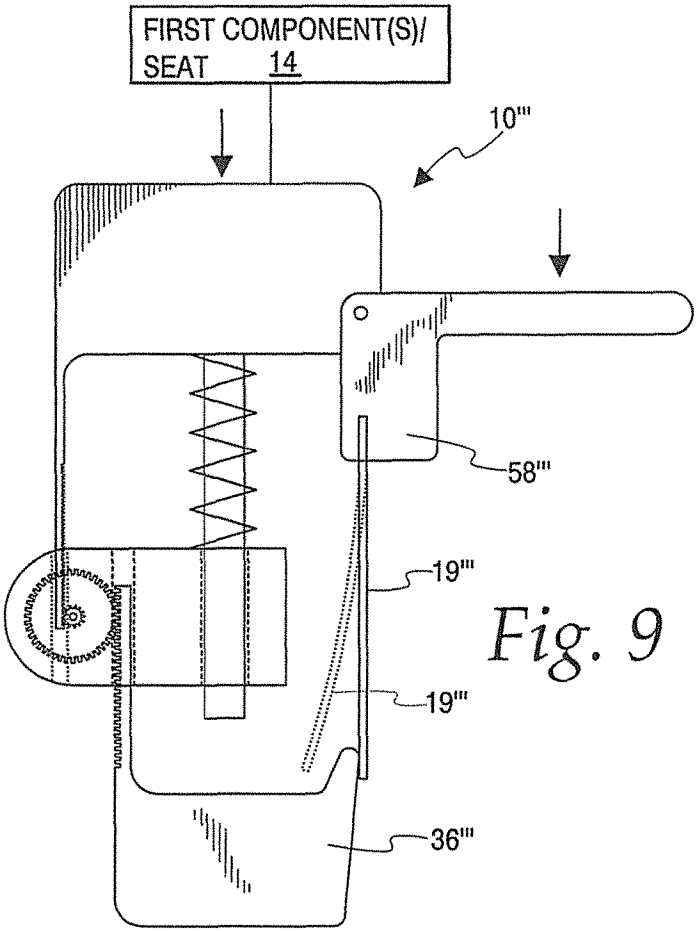

In a further modified form of chair, as shown at 10''' in FIG. 9, the basic construction of FIGS. 3 and 7 is utilized with the exception that the leaf spring 19''' is fixedly mounted to the component 58''' and acts against the member 36''', i.e., this component arrangement is reversed from that in the earlier embodiments. The leaf spring 19''' is preloaded from the dotted line position into the solid line position which is maintained by the abutment thereof to the member 36'''.

In FIGS. 10 and 11, a further modified form of chair, according to the invention, is shown at $\mathbf{10}^{4'}$. In this embodiment, multiple leaf springs $\mathbf{19}a^{4'}$, $\mathbf{19}b^{4'}$, $\mathbf{19}c^{4'}$, $\mathbf{19}d^{4'}$ are utilized, each with an end anchored in a block 105.

In this embodiment, the post $\mathbf{30}^{4'}$ has a toothed rack $\mathbf{100}^{4'}$ that cooperates with a toothed, differential pinion element $\mathbf{88}^{4'}$, that cooperates in turn with a toothed rack $\mathbf{98}^{4'}$ making up part of a toothed element $\mathbf{86}^{4'}$ on a member $\mathbf{36}^{4'}$.

Downward movement of the post $\mathbf{30}^{4'}$ under the weight applied to the seat 14 causes the toothed rack $\mathbf{100}^{4'}$ and toothed element $\mathbf{88}^{4'}$, and separately the toothed elements $\mathbf{88}^{4'}$, $\mathbf{86}^{4'}$, to interact to translate the member $\mathbf{36}^{4'}$ in the direction of the arrow 106.

As the weight on the seat 14 is increased, the member $\mathbf{36}^{4'}$ will move continuously in the direction of the arrow, 106 to successively engage free ends of angled extensions 108*a*, 108*b*, 108*c* at the ends of leaf springs $\mathbf{19}a^{4'}$, $\mathbf{19}b^{4'}$, $\mathbf{19}c^{4'}$, successively. The extensions 108*a*, 108*b*, 108*c* and one surface 110 on the leaf spring $\mathbf{19}d^{4'}$ reside in a reference plane P. As user applied weight increases, a surface 112 on the member $\mathbf{36}^{4'}$ moves along this plane P to successively engage the extensions 108*a*, 108*b*, 108*c* and eventually the surface 110, whereby the surface 112 defines separate fulcrum locations, corresponding to the fulcrum location 66, for the free ends of the leaf springs 19$a^{4'}$, 19$b^{4'}$, 19$c^{4'}$, 19$d^{4'}$. In other words, the leaf springs 19$a^{4'}$, 19$b^{4'}$, 19$c^{4'}$, 19$d^{4'}$ are successively operatively engaged under increasing user weight. As a result, the resistance force to the applied leaning force on the back rest 18 in the direction of the arrow 114 is generated by some or all of the leaf springs 19$a^{4'}$, 19$b^{4'}$, 19$c^{4'}$, 19$d^{4'}$ as they are borne against the surface 112 under the user leaning force.

It is important to point out that the rack and pinion components are not restricted to any specific orientation. The cooperating rack and pinion components may be oriented in virtually any orientation that can be adapted to cause movement of the associated parts in the same manner.

Further, one or all of the leaf springs 19$a^{4'}$, 19$b^{4'}$, 19$c^{4'}$, 19$d^{4'}$ could be pre-loaded or in curved tracks.

In an alternative form of the basic structure in FIGS. 10 and 11, as shown for the chair 10$^{5'}$ in FIGS. 12 and 13, the member 36$^{5'}$ vertically advanced, or advanced in another direction, is caused to interact with some, or all, of a plurality, and in this case three, leaf springs 19$a^{5'}$, 19$b^{5'}$, 19$c^{5'}$, which are arranged to be substantially coplanar, as opposed to stacked as the leaf springs 19$a^{4'}$, 19$b^{4'}$, 19$c^{4'}$, 19$d^{4'}$ are on the chair 10$^{4'}$.

Under an increasing user weight on the seat 14, a surface 112$^{5'}$ on the member 36$^{5'}$ engages successively against surfaces 116$a^{5'}$, 116$b^{5'}$, 116$c^{5'}$. As shown in FIG. 12, the particular exemplary weight causes engagement of the surface 112$^{5'}$ with only two of the leaf springs 19$a^{5'}$, 19$b^{5'}$.

The leaning force on the back rest 18 is applied on an actuator 118 in a direction into the page, as indicated by the "X" at 120. Resistance to the leaning force is generated in the same manner for the chair 10$^{5'}$ as for the chair 10$^{4'}$ but with the different arrangement of leaf springs.

In an alternative form, each of the leaf springs in FIGS. 12 and 13 might be substituted for by coil springs, compression/tension springs, or a torsion rod of the type described in an additional embodiment below. One or more springs might be utilized. More springs allow for finer control. Each spring can be individually tuned.

Figure 14:
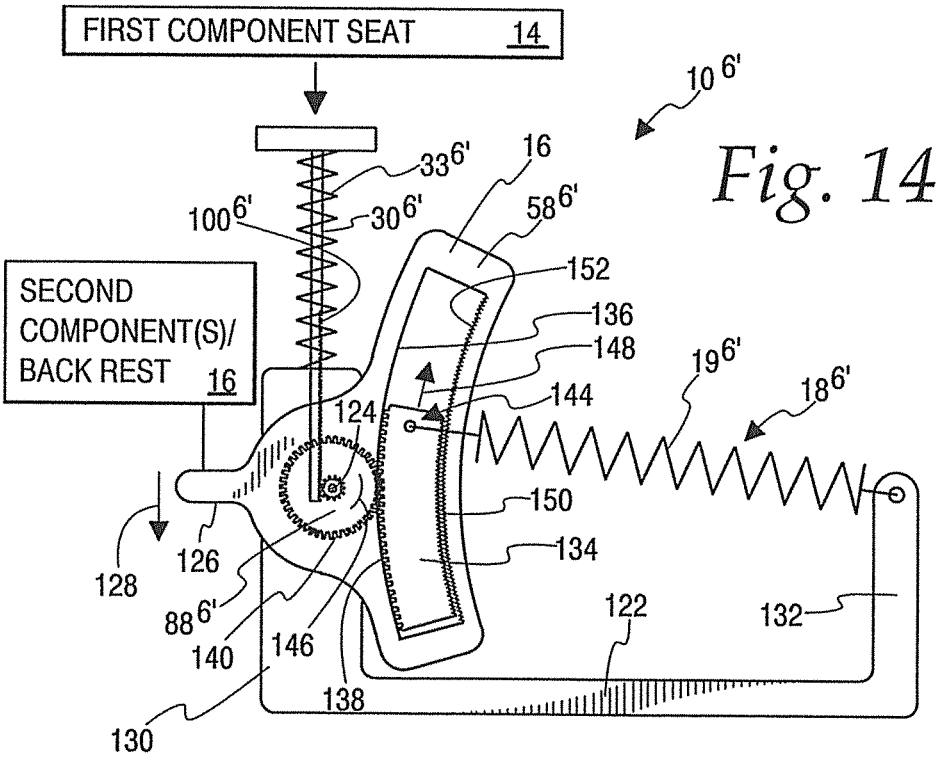

In FIG. 14, a further modified form of chair, according to the invention, is shown at 10$^{6'}$. A post 30$^{6'}$ has a toothed rack 100$^{6'}$ that cooperates with a differential pinion/toothed element 88$^{6'}$. The toothed element 88$^{6'}$ moves together with a component 58$^{6'}$ that is part of the back rest 16 or otherwise moves in response to movement thereof. The component 58$^{6'}$ is mounted for pivoting movement relative to a frame part 122 around an axis 124 as the post 30$^{6'}$ raises and lowers as different weight forces are applied to and removed from the seat 14.

The leaning force on the back rest 16 is applied to an arm 126 on the component 58$^{6'}$ in the direction of the arrow 128.

The frame part 122 has a "U" shape with spaced legs 130, 132. The component 58$^{6'}$ is mounted on the leg 130.

The toothed element 88$^{6'}$ cooperates with a separate toothed element 134 that moves guidingly in a channel 136 on the component 58$^{6'}$. In this embodiment, the toothed element 134 and cooperating channel 136 have a curved shape so that the toothed element 134 is movable guidingly in an arcuate path. A row of teeth 138 on one side of the toothed element 134 engage teeth 140 on the toothed element 88$^{6'}$ so that the toothed element 134 moves back and forth within the channel 136 as the toothed element 88$^{6'}$ is rotated in opposite directions around its axis 124.

The adjusting assembly 18$^{6'}$ in this embodiment consists of an elongate spring assembly 19$^{6'}$, in this particular embodiment shown as a coil spring under tension. The spring 19$^{6'}$ is connected between an end location at 144 on the toothed element 134 and the leg 132 on the frame part 122.

As a user sits on the seat 14, without leaning against the back rest 16, the post 30$^{6'}$ moves against the force of the spring 33$^{6'}$ downwardly, thereby turning the toothed element 88$^{6'}$ in the direction of the arrow 146, which causes the toothed element 134 to move in the direction of the arrow 148 in the channel 136. The precise position of the toothed element 134 in the channel 136 is dictated by the weight of the user.

Once the user is seated and leans back against the back rest 16, separate teeth 150, 152, on the toothed element 134 and component 58$^{6'}$, within the channel 136, engage, thereby to fix the position of the toothed element 134 within the channel 136.

Under an applied leaning force in the direction of the arrow 128 on the arm 126, the component 58$^{6'}$, and the associated back rest 16, tend to pivot around the axis 124, which is resisted by the force in the spring 142. Because the distance between the axis 124 and end location 144 where the resistant spring force is applied is increased with increasing weight of a user, the resistant force generated by the coil spring 19$^{6'}$ is likewise increased.

Figure 15:
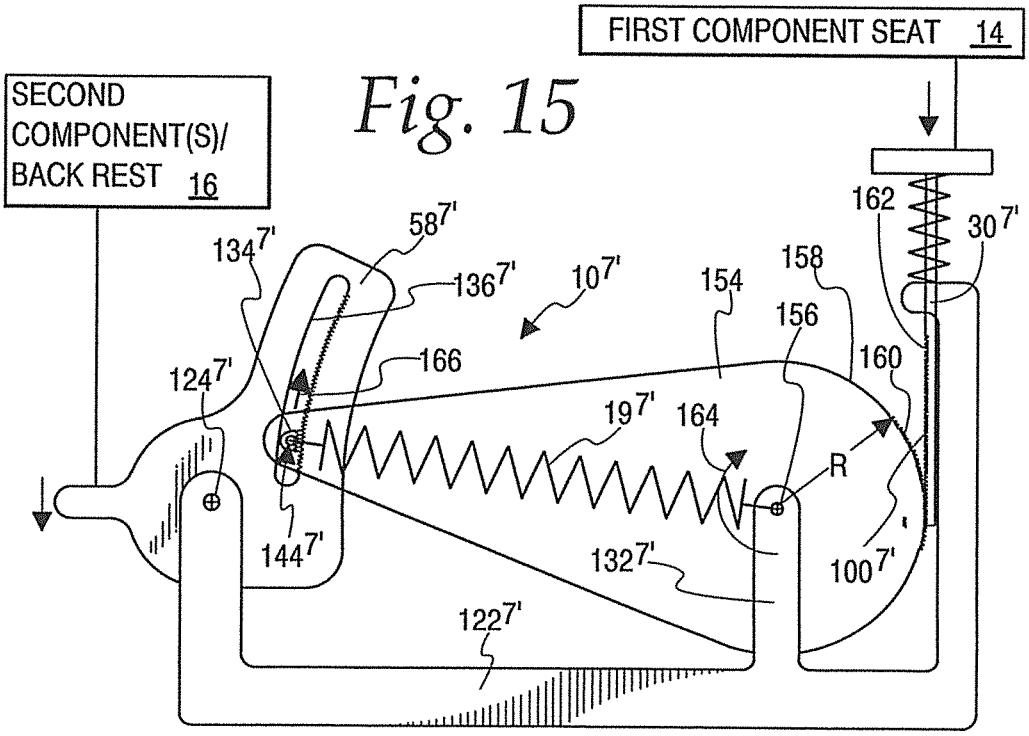

The chair 10$^{7'}$ in FIG. 15 operates on the same basic principles as the chair 10$^{6'}$ in FIG. 14.

More particularly, a toothed element 134$^{7'}$ moves in a channel 136$^{7'}$ having an arcuate shape. A coil spring 19$^{7'}$ connects between the toothed element 134$^{7'}$ and a leg 132$^{7'}$ on a U-shaped frame part 122$^{7'}$.

The primary difference between the structure in FIG. 15, compared to that in FIG. 14, is that the toothed element 134$^{7'}$ is part of, and moves with, an elongate component 154 that is pivoted about an axis 156 that is the approximate location at which the spring 19$^{7'}$ connects to the leg 132$^{7'}$. The component 154 has a curved edge 158 with a constant radius R centered on the axis 156. That edge 158 has teeth 160 which mesh with teeth 162 on a post 30$^{7'}$ that has a toothed rack 100$^{6'}$ where the teeth 162 are located.

Increased weight of a user on the seat 14 pivots the component 154 in the direction of the arrow 164 around the axis 156 to move the toothed element 134$^{7'}$ in the direction of the arrow 166 in the channel 136$^{7'}$. In so doing, the distance between the spring mount location at 144$^{7'}$ on the toothed element 134$^{7'}$ and the pivot axis 124$^{7'}$ for the component 58$^{7'}$ increases, thereby to cause an increase in the resistance to tilting of the back rest 16 in the same manner as occurs with the chair 10$^{6'}$.

Figure 16:
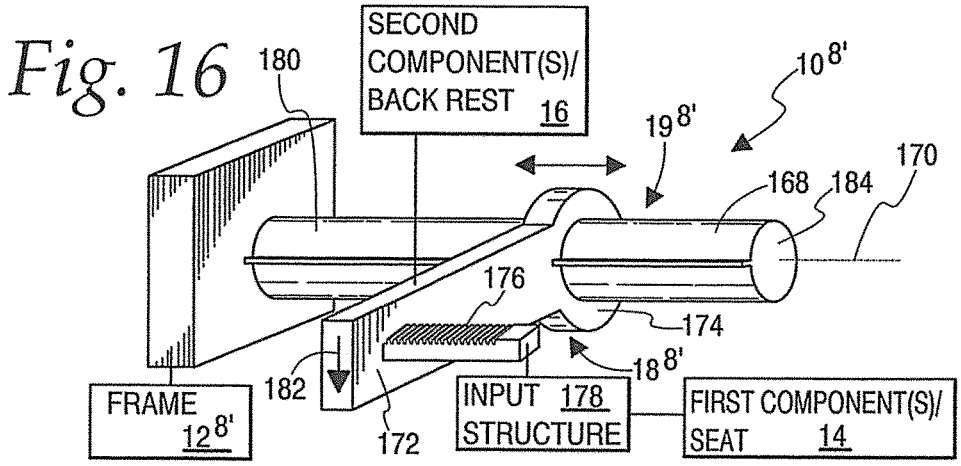

In FIG. 16, a further modified form of chair is shown at 10$^{8'}$ wherein the spring assembly 19$^{8'}$ includes an elongate torsion component 168 with a lengthwise axis 170. The adjusting assembly 18$^{8'}$ further includes an actuating component 172 that has a portion 174 keyed to the periphery of the torsion component 168 to move slidingly axially thereallong in the same angular orientation. With the torsion component 168 fixed in relationship to the frame 12$^{8'}$, a user's weight on the seat 14 causes movement of the actuating component 172 through cooperation between a toothed rack 176 thereon and intermediate input structure 178 of suitable construction. Increased weight on the seat 14 causes the actuating component 172 to shift closer to a base 180 of the torsion component 168 closer to where it is anchored to the frame 12$^{8'}$.

A leaning force on the back rest 16 is applied to the torsion component generally in the direction of the arrow 182, tending to turn the torsion component 168 around the axis 170. For the back rest 16 to reposition, the torsion component 168 must be twisted around the axis 170. This twisting action is resisted to a greater degree with the actuating component 172 closer to the base 180 under a heavier user weight.

On the other hand, with the actuating component 172 shifted towards its free end 184, as occurs with a lighter user, the torsion component 168 can be more readily twisted about its length and the axis 170.

Figure 17:
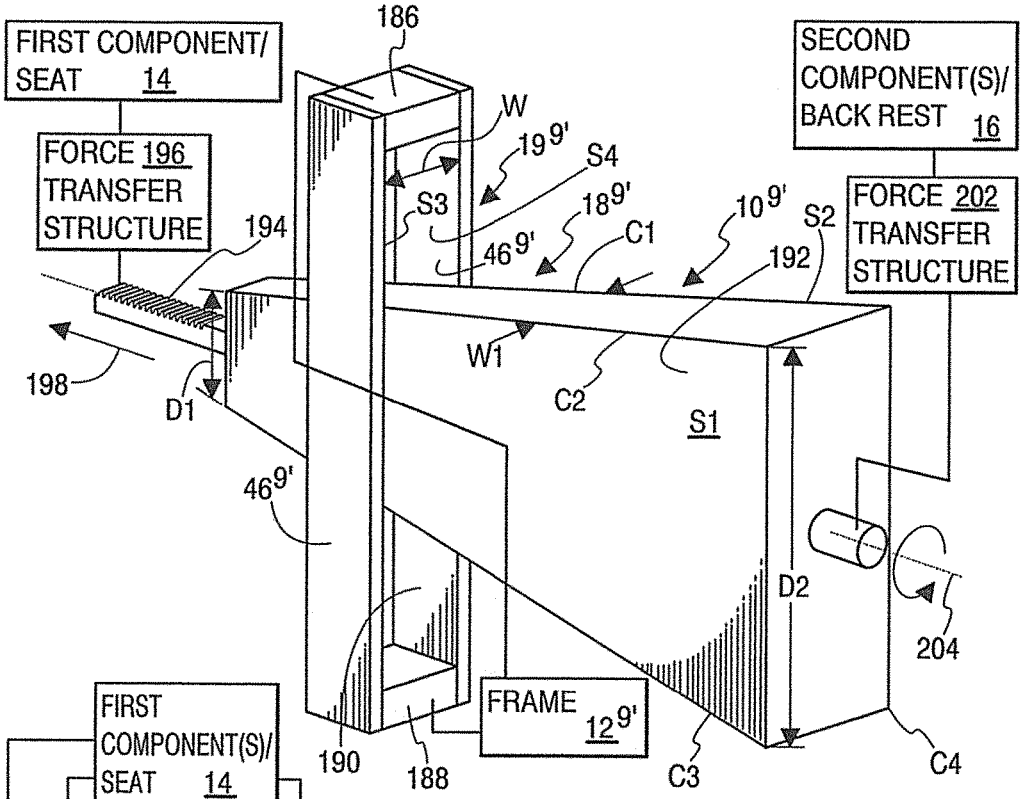
FIG. 17 is a schematic representation of a further modified form of reconfigurable apparatus, according to the present invention.

In FIG. 17, a still further modified form of chair, according to the invention, is shown at 10$^{9'}$ with an adjusting assembly 18$^{9'}$ cooperating between a seat 14 and back rest 16. A spring assembly 19$^{9'}$ is mounted to a frame 12$^{9'}$ and consists of separate leaf springs with bodies 46$^{9'}$ each with spaced ends supported by blocks 186, 188 on the frame 12$^{9'}$. With this arrangement, the bodies 46$^{9'}$ and blocks 186, 188 cooperatively extend around an opening 190 with a width W.

An elongate, wedge-shaped actuating component 192 with a uniform width W1, slightly less than the width W, extends through the opening 190.

A toothed rack 194 is provided on the actuating component 192 and moves therewith. In response to a weight force being applied to the seat 14, and through an appropriate force transfer structure 196, the toothed rack 194 and actuating component 192 are shifted in the direction of the arrow 198.

By reason of the wedge shape, the actuating component 192 has oppositely facing actuating surfaces S1, S2, each with one dimension D1 at one end and a larger dimension D2 at its opposite end, that abut to, or reside adjacent to, facing surfaces S3, 84, respectively, on the bodies 46$^{9'}$. As the actuating component 192 shifts in the direction of the arrow 198, a progressively larger area of the surfaces S1, S2 confronts the leaf spring bodies 46$^{9'}$.

The back rest 16 imparts a force to the actuating component 192 through a suitable force transfer structure at 202 tending to turn the actuating component 192 around an axis 204.

Accordingly, a user leaning force generates a force on the actuating component 192 that bears the surfaces S1, S2 simultaneously against the surfaces S3, S4 of the leaf spring bodies 46$^{9'}$ between the spaced supported ends. The larger the area of the surfaces S1, S2 in contact with the bodies 46$^{9'}$, the more resistant the bodies 46$^{9'}$ are to deformation. This translates into a greater resistance to the repositioning of the back rest 16 for a larger weight application on the seat 14.

Further, as the actuating component 192 turns around the axis 204, the force transfer between the actuating component 192 and bodies 46$^{9'}$ occurs primarily at corners C1, C2, C3, C4 of the actuating component 192, which bear against reinforced and thus more rigid parts of the bodies 46$^{9'}$ adjacent to the blocks 186, 188 as more user weight is applied. Thus, greater resistance to back rest movement results.

Figure 18:
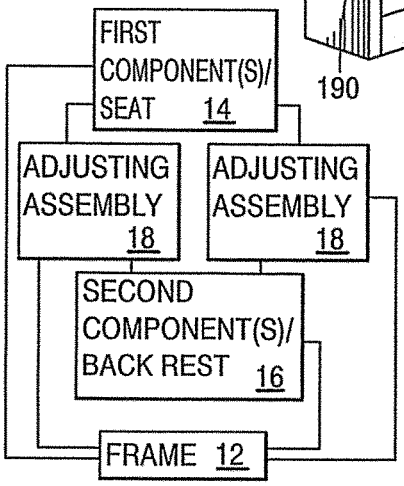
FIG. 18 is a schematic representation of adjusting assemblies, according to the invention, acting between separate components on a frame.

In a still further alternative form, as shown in FIG. 18, multiple adjusting assemblies 18 are utilized between a cooperating first component(s)/seat 14 and second component(s)/back rest 16 on a frame 12.

Ideally, the apparatus/chair 10 will adapt to users weighing as much as 350 pounds, or more. While one spring assembly might be designed for a total desired weight range to be accommodated, two or more spring assemblies might be utilized and their function and operation coordinated.

Further, different spring assemblies might be utilized with coordinated operation. For example, one spring assembly may cover a range of 30-175 pounds with a second spring assembly operational for user weights in the range of 175-350 pounds. More springs/spring assemblies might be added to further split up the weight ranges.

The spring assemblies may be designed in relationship to seat movement. For example, one spring assembly may be operational for 0-0.5" of seat movement with a separate spring assembly operational for seat movement of 0.5"-1", where 1" is the seat movement for the maximum weight for which the apparatus is designed.

The examples herein of spring assembly/spring construction should not be viewed as limiting. Different spring types and combinations are contemplated. For example, the springs may be curved, coiled with different turn diameter and rise, hybrid shapes, concentric arrangements, etc. Coil springs, or the like, may produce forces under either compression or tension.

The foregoing disclosure of specific embodiments is intended to be illustrative of the broad concepts comprehended by the invention.

The invention claimed is:

1. A reconfigurable apparatus for supporting at least part of a user's weight with the user in an operative position with respect to the reconfigurable apparatus, the reconfigurable apparatus comprising:

a frame;

a first component on the frame upon which a force is applied by a user in a first manner as an incident of the user assuming the operative position;

at least a second component on the frame that is movable relative to the first component and upon which a force can be applied by a user in the operative position in a second manner to reconfigure the apparatus by moving the at least second component relative to the first component; and an adjusting assembly cooperating between the first component and the at least second component and configured so that as an incident of the force being applied in the first manner changing in magnitude, the force required to be applied in the second manner to reconfigure the apparatus and move the second component relative to the first component changes in magnitude.

2. The reconfigurable apparatus according to claim 1 wherein the second component is guided in pivoting movement relative to the first component around an axis.

3. The reconfigurable apparatus according to claim 1 wherein the reconfigurable apparatus is a piece of furniture.

4. The reconfigurable apparatus according to claim 3 wherein the reconfigurable apparatus is a chair in which a user in the operative position is seated, with the first component comprising a seat upon which a user applies the force in the first manner by sitting in the chair.

5. The reconfigurable apparatus according to claim 4 wherein the at least second component comprises a back rest against which a user seated in the chair leans to exert the force in the second manner to reconfigure the chair.

6. The reconfigurable apparatus according to claim 5 wherein the adjusting assembly comprises a spring assembly that is configured to exert a force that resists movement of the at least second component relative to the first component and that varies as the magnitude of the force applied in the first manner varies.

7. The reconfigurable apparatus according to claim 6 wherein the spring assembly comprises a leaf spring with a length that is bendable about a fulcrum location and the adjusting assembly and at least second component are configured so that as the force applied in the first manner changes in magnitude an effective length of the leaf spring changes.

8. The reconfigurable apparatus according to claim 1 wherein the adjusting assembly is configured so that an increase in magnitude of the force applied in the first manner causes an increase in magnitude of the force applied in the second manner required to reconfigure the apparatus.

9. The reconfigurable apparatus according to claim 7 wherein the leaf spring has a cross-sectional shape as viewed orthogonally to its length that is non-uniform over at least a portion of the length of the leaf spring.

10. The reconfigurable apparatus according to claim 6 wherein the spring assembly comprises a plurality of leaf springs each with a length that bends around a fulcrum location.

11. The reconfigurable apparatus according to claim 10 wherein the adjusting assembly and at least second component are configured so that a different number of said plurality of leaf springs exerts a force that resists movement of the at least second component based upon a magnitude of the force applied in the first manner.

12. The reconfigurable apparatus according to claim 6 wherein the spring assembly comprises an elongate spring component with a length that exerts the force that resists movement of the at least second component in line with the length of the spring.

13. The reconfigurable apparatus according to claim 12 wherein the second component is guided in pivoting movement relative to the at least first component and/or the frame around an axis and the second component and adjusting assembly are configured so that the elongate spring component exerts the force that resists movement of the at least second component at a distance from the axis that changes as a magnitude of the force applied in the first manner changes.

14. The reconfigurable apparatus according to claim 6 wherein the spring assembly comprises at least one leaf spring.

15. The reconfigurable apparatus according to claim 14 wherein the at least one leaf spring has a length and spaced supported ends and the apparatus further comprises an actuating component that is configured to bear against the one leaf spring between the spaced supported ends to resist movement of the at least second component as the force is applied in the second manner with a magnitude that reconfigures the apparatus.

16. The reconfigurable apparatus according to claim 6 wherein the spring assembly comprises a torsion component with an axis and the apparatus further comprises an actuating component that is configured to turn the torsion component around the axis to generate the force that resists movement of the at least second component as the force is applied in the first manner with a magnitude that reconfigures the apparatus.

17. The reconfigurable apparatus according to claim 16 wherein the actuating component and torsion component are configured so that the actuating component engages the torsion component at different locations along the axis of the torsion component as a magnitude of the force applied in the first manner changes.

18. The reconfigurable apparatus according to claim 1 wherein the adjusting assembly comprises cooperating toothed elements that move relative to each other as a magnitude of the force applied in the first manner reaches a predetermined level.

19. The reconfigurable apparatus according to claim 4 wherein the seat is configured to move vertically relative to the frame with the first force applied in the first manner with a magnitude that reaches a predetermined level.

20. The reconfigurable apparatus according to claim 1 wherein the apparatus further comprises a supporting biasing assembly that normally biasably urges the seat upwardly relative to the frame.

21. The reconfigurable apparatus according to claim 2 wherein the axis is spaced from the first component.

22. The reconfigurable apparatus according to claim 5 wherein the back rest is spaced from the seat.

* * * * *